United States Patent [19]

Fujita et al.

[11] Patent Number: 4,696,696

[45] Date of Patent: Sep. 29, 1987

[54] SINTERED ALLOY HAVING IMPROVED WEAR RESISTANCE PROPERTY

[75] Inventors: Yoshiaki Fujita, Saitama; Satoshi Kawai, Tochigi, both of Japan

[73] Assignee: Nippon Piston Ring Co., Ltd., Tokyo, Japan

[21] Appl. No.: 870,373

[22] Filed: Jun. 4, 1986

[30] Foreign Application Priority Data

Jun. 17, 1985 [JP] Japan ..... 60-130006

[51] Int. Cl.[4] ..... C22C 29/02

[52] U.S. Cl. ..... 75/246; 75/236; 75/240; 75/241; 75/242; 419/47

[58] Field of Search ..... 75/246, 236, 240, 241, 75/242; 419/47

[56] References Cited

U.S. PATENT DOCUMENTS

| | | | |
|---|---|---|---|
| 3,471,343 | 10/1969 | Koehler | 75/246 |
| 3,656,917 | 4/1972 | Kikkawa et al. | 75/246 |
| 3,993,445 | 11/1976 | Reen | 75/246 |
| 4,115,158 | 9/1978 | Reen | 75/246 |
| 4,128,420 | 12/1978 | Esper et al. | 75/246 |
| 4,236,945 | 12/1980 | Reen | 75/246 |
| 4,253,874 | 3/1981 | Cundill | 75/246 |
| 4,494,988 | 1/1985 | Schumacher et al. | 75/246 |
| 4,561,889 | 12/1985 | Oaku et al. | 419/47 |

*Primary Examiner*—Stephen J. Lechert, Jr.

*Attorney, Agent, or Firm*—Finnegan, Henderson Farabow, Garrett and Dunner

[57] ABSTRACT

A wear resistant sintered alloy consisting essentially of from 2.0% to 3.5% by weight of C, from 0.3% to 0.8% by weight of P, from 0.5% to 3.0% by weight of Mn and remainder Fe. The alloy is sintered in the liquid-phase.

8 Claims, 1 Drawing Figure

SINTERED ALLOY HAVING IMPROVED WEAR RESISTANCE PROPERTY

BACKGROUND OF THE INVENTION

The present invention generally relates to a sintered alloy having an improved wear resistance property for use as a material of a sliding member in an internal combustion engine, and particularly relates to a sintered alloy having an improved wear resistance property for use as a material of a journal member of a cam shaft.

Recently, various members to be used in an internal combustion engine have been required to be capable of enduring against a high load operation, and particularly sliding members such as a cam shaft, a rocker arm, etc., have been required to have durability against a high surface pressure. In order to satisfy this requirement and to reduce the working and material costs of the sliding members and the weight of the same, a sintered material of alloy powder has been examined to be used as the material of the sliding members.

In the case where molybdenum, chromium, or the like, is added into an Fe-C-P alloy system conventionally used as a material of a journal member, a hard carbide principally containing $(Fe, Cr)_3C$, $(Fe, Cr, Mo)_3C$, or the like, is formed. Although the matrix of the material is strengthened, martensite transformation or bainite transformation of the base is simultaneously promoted. Therefore, although being superior in wear resistance property, the resultant sintered material is reduced in machinability so that it is unsuitable as the material for the journal member because the material is necessary to be subject to cutting.

Further, in the journal member material such as an Fe-C-P alloy system or an Fe-C-P-Cu alloy system, it is impossible to rapidly complete diffusion among particles when the journal member is sintered in a liquid phase at a high temperature, so that a wrinkle or a crack is generated in the vicinity of the surface of the journal member. In order to cope with the foregoing disadvantage, there has been proposed such a method that chromium or molybdenum is added to the foregoing system. However, the addition has such a problem as described above. Further, it is considered to increase the content of phosphorus. However, if the quantity of phosphorus is increased so much, the liquid phase may become so excessive that a carbide (containing a steadite) is greatly formed.

SUMMARY OF THE INVENTION

An object of the present invention is to satisfy the foregoing requirements in the prior art.

Another object of the present invention is to provide a sintered alloy which has a high wear resistance property and which is superior in workability as a material of a sliding member to be used in an internal combustion engine.

The foregoing objects of the present invention are attained by a wear-resistive sintered alloy consisting essentially of from 2.0% to 3.5% by weight of C, from 0.3% to 0.8% by weight of P, from 0.5% to 3.0% by weight of Mn, and the remainder of Fe, and being sintered in a liquid phase, or by a wear-resistive sintered alloy further comprising from 0.5% to 2.0% by weight of Si and/or from 0.2% to 3.0% by weight of Ni in addition to the components of the first-mentioned sintered alloy. In the case where from 0.5% to 2.0% by weight of Si is included, the amount of Mn is in the range from more than 1.0% up to 3.0% by weight.

Next, description will be made as to the reason why the numerical percentile values of the respective components of the sintered alloy according to the present invention are defined in such a manner as above.

The reason why the amount of addition of carbon is defined to be from 2.0 to 3.5% by weight is as follows. In the case where carbon exceeds 3.5% by weight, the quantity of produced graphite is so large that a crack is apt to be caused and that hardness of resultant alloy is reduced. Further, a steadite which is an eutectic crystal of a cementite having exceedingly high hardness and an Fe-C-P is excessively produced, so that machinability of the alloy is lowered. In the case where the quantity of carbon is less than 2.0% by weight, on the contrary, the generation amount of the cementite and steadite is so small that it becomes impossible to make the alloy having sufficient wear resistance. The steadite has a low solidifying point of about 950° C. so as to progress the liquid-phase sintering, and therefore, if the amount of steadite is small, the liquid phase is hardly generated. Accordingly, in the case where the range of composition of carbon is defined to be 2.0% to 3.5% both inclusive by weight, a high wear resistance property of the alloy can be obtained because the optimum amount of cementite and steadite is generated, and the liquid-phase sintering can be progressed because of the formation of the steadite.

The reason why the amount of phosphorus is defined to be from 0.3% to 0.8% by weight is as follows. In the case where the amount of phosphorus exceeds 0.8% by weight, steadite is excessively precipitated, so that the machinability of the alloy is lowered and the brittleness of the same is increased. If the amount of the same is less than 0.3% by weight, on the other hand, the amount of precipitation of the steadite is so small that the liquid phase is hardly generated, and therefore the capability of joining to base member is reduced.

The amount of addition of manganese is generally defined to be from 0.5% to 3.0% by weight, so that the sinterability of the matrix is improved and the sintering temperature can be reduced. Consequently, expansion and shrinkage of the alloy mass caused when the matrix is heated and cooled in sintering can be reduced so that wrinkles and cracks can be prevented. Further, the matrix of the matrix can be suitably strengthened so that the wear resistance property of the same is not reduced. In the case where the amount of addition of manganese exceeds 3.0% by weight, the compactability of alloy powder is reduced to decrease the density of the powder compact. Moreover, when the amount of oxygen is increased, the sinterability is undesirably hindered to reduce the bonding property and apparent hardness of the same. The bonding property implies sinter bonding property to another mechanical component such as a cam shaft. In this case, diffusion bonding occurs at the interface between the sintered alloy member and the cam shaft. In the case where the amount of addition of manganese is less than 0.5% by weight, on the other hand, no effect is caused by such extremely small amount of addition of manganese.

According to the present invention, it is preferable to add silicon to the powder of manganese. When manganese power including silicon is added to the alloy, the deoxidation effect of silicon must be taken into consideration. As a result, variations in the density and the hardness of the alloy can be suppressed to some extent, so that it is possible to stabilize the alloy sinterability. When silicon is added, however, deformation of the powder compact at sintering may occur. This tendency cannot be compensated if the amount of addition of manganese is equal to or less than 1.0% by weight, and therefore, the amount of addition of manganese is defined to be from more than 1.0% up to 3.0% inclusive by weight in the case silicon is added.

The reason why the amount of addition of silicon is defined to be from 0.5% to 2.0% by weight is as follows. When the amount of silicon exceeds 2.0% by weight, the brittleness of the base is increased and powder compactibility is reduced, so that resultant sintered product is largely deformed. Silicon acts as a component for progressing generation of the liquid phase with the respective amounts of carbon and phosphorus being selected to be low. The effect of this action of the additive silicon cannot be obtained when the amount of silicon is selected to be less than 0.5% by weight.

According to the present invention, also it is preferable to add nickel within a range of from 0.2% to 3.0% by weight. Nickel is added because the nickel can act as an element for strengthening the matrix. If the amount of addition of nickel exceeds more than 3.0% by weight, however, precipitation of carbide, the martensite transformation and bainite transformation of the matrix are increased, so that the machinability of the alloy is lowered. If the amount of addition of nickel is less than 0.2% by weight, on the other hand, the addition provides no effect onto the alloy.

BRIEF DESCRIPTION OF THE DRAWINGS

Single FIGURE is a microphotograph (corroded with a nital etching reagent and enlarged with 240 magnifications) showing the matrix in Example 1 of the sintered alloy according to the present invention.

DETAILED DESCRIPTION OF THE INVENTION

Figure 1:
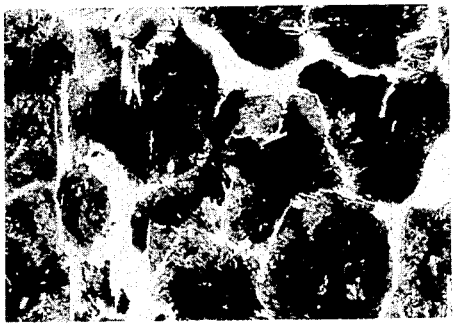

The present invention will be described specifically with reference to examples of the invention and comparative examples, hereunder.

Examples 1–3 and Comparative Examples 1–3

Wear-resistive sintered alloys having compositions as shown in Table 1 were obtained. The method of producing these wear-resistive sintered alloys is as follows. That is, in each of Examples 1 to 3, after press-compacting at a pressure of 4 to 6 t/cm$^2$, the material was put in a furnace in an atmosphere of an ammonia-decomposed gas and sintered at a temperature of 1050° to 1200° C. (a mean value of temperature is 1120° C.), and the wear-resistive sintered alloys were obtained.

The sintered alloys were evaluated as to their external appearance, bonding property, sinterability, machinability, hardness, and status of matrix. The results are shown in Table 2. The single FIGURE is a microphotograph (corroded by a nital etching reagent and enlarged with 240 magnifications) showing the matrix of Example 1.

Further, for the purpose of comparison, sintered alloys conventionally used as materials of journal members were prepared, each being made of Fe-C-P-Cu alloy system (Comparative Example 1), Fe-C-P-Mo alloy system (Comparative Example 2), and Fe-C-P-Mo-Cr alloy system (Comparative Example 3). The compositions and the results of evaluation are shown in Tables 1 and 2 respectively.

TABLE 1

| | Alloy Composition | | | | | | | | |
|---|---|---|---|---|---|---|---|---|---|
| | C | P | Mn | Si | Ni | Cu | Mo | Cr | Fe |
| Example 1 | 2.5 | 0.6 | 1.0 | | | | | | Remainder |
| Example 2 | 2.2 | 0.6 | 1.5 | 0.9 | | | | | Remainder |
| Example 3 | 2.8 | 0.5 | 2.0 | | 1.5 | | | | Remainder |
| Comparative Example 1 | 2.2 | 0.6 | | | | 2.1 | | | Remainder |
| Comparative Example 2 | 2.2 | 0.6 | | | | | 0.8 | | Remainder |
| Comparative Example 3 | 1.9 | 0.5 | | | | | 1.0 | 2.5 | Remainder |

TABLE 2

| | Evaluation of Alloy | | | | | |
|---|---|---|---|---|---|---|
| | Appearance | Bonding | Sinterability | Machinability | Hardness | Composition of Base |
| Example 1 | no wrinkle No crack | Good | Good | Good | HRB 102 | Carbide and steadite are uniformly distributed in a dense pearlitic matrix. |
| Example 2 | No wrinkle No crack | Good | Good | Good | HRB 98 | Carbide and steadite are uniformly distributed in a dense pearlitic matrix. |
| Example 3 | No wrinkle | Good | Good | Good | HRB 105 | Carbide and steadite are uniformly distributed in a dense pearlitic matrix. |
| Comparative Example 1 | Wrinkles Cracks | Bad | Bad | Bad | HRB 107 | Carbide, steadite and free Cu are distributed in a pearlitic matrix. |
| Comparative Example 2 | No wrinkle No crack | Good | Good | Bad | HRB 112 | A large quantity of carbide including Mo carbide and steadite are distributed in a dense pearlitic matrix. |
| Comparative Example 3 | No wrinkle No crack | Good | Good | Bad | HRC 42 | Carbide of Cr and Mo and steadite are distributed in a pearlitic matrix. |

As shown in Table 2, there was no defect in appearance as well as in microscopical view in the outer peripheral and side surfaces of the journal member in each of Examples 1 to 3, while wrinkles and cracks were caused in Comparative Example 1 (Fe-C-P-Cu alloy system). Further, Examples 1 to 3 were good in bonding as well as in sinterability. As to the hardness, HRB was within a range from 98 to 105 so that the workability was good in each of Examples 1 to 3. However, HRB was within a range from 105 to 112 in Comparative Example 1 (Fe-C-P-Cu alloy system), and within a range from 107 to 114 in Comparative Example 2 (Fe-C-P-Mo alloy system). The hardness was further increased in Comparative Example 3(Fe-C-P-Mo-Cr alloy system) in which chromium is added to the composition of Comparative Example 2. Further, as shown in Table 2 and the FIGURE, in the composition of each of Examples 1 to 3, carbide (white portions in FIGURE) containing steadite is uniformly distributed in a dense pearlitic matrix and there was no problem in wear resistance property.

As described above, the sintered alloy according to the present invention is superior in wear resistance property, in workability such as machinability, etc. Further, various properties such as bonding, sinterability, and the like, can be achieved within desirable ranges, so that the sintered alloy according to the present invention is suitably used as a material of the sliding member, particularly, the journal member, in an internal combustion engine.

What is claimed is:

1. A wear-resistant sintered alloy consisting essentially of: from 2.0% to 3.5% by weight of C, from 0.3% to 0.8% by weight of P, from 0.5% to 3.0% by weight of Mn, and remainder Fe, said alloy being sintered in liquid phase.

2. A wear-resistant sintered alloy consisting essentially of: from 2.0% to 3.5% by weight of C, from 0.3% to 0.8% by weight of P, from more than 1.0% up to 3.0% by weight of Mn, from 0.5% to 2.0% by weight of Si, and remainder Fe, said alloy being sintered in liquid phase.

3. A wear-resistant sintered alloy consisting essentially of: from 2.0% to 3.5% by weight of C, from 0.3% to 0.8% by weight of P, from 0.5% to 3.0% by weight of Mn, from 0.2% to 3.0% by weight of Ni, and remainder Fe, said alloy being sintered in liquid phase.

4. A wear-resistant sintered alloy consisting essentially of: from 2.0% to 3.5% by weight of C, from 0.3% to 0.8% by weight of P, from more than 1.0% up to 3.0% by weight of Mn, from 0.5% to 2.0% by weight of Si, from 0.2% to 3.0% by weight of Ni, and remainder Fe, said alloy being sintered in liquid phase.

5. A wear-resistant sintered alloy as claimed in claim 1, wherein said alloy has a structure in which carbide and steadite are uniformly distributed in a dense pearlitic matrix.

6. A wear-resistant sintered alloy as claimed in claim 2, wherein said alloy has a structure in which carbide and steadite are uniformly distributed in a dense pearlitic matrix.

7. A wear-resistant sintered alloy as claimed in claim 3, wherein said alloy has a structure in which carbide and steadite are uniformly distributed in a dense pearlitic matrix.

8. A wear-resistant sintered alloy as claimed in claim 4, wherein said alloy has a structure in which carbide and steadite are uniformly distributed in a dense pearlitic matrix.

* * * * *